US005372249A

United States Patent [19]

Grange

[11] Patent Number: 5,372,249

[45] Date of Patent: Dec. 13, 1994

[54] DEVICE FOR KEEPING A RAZOR

[75] Inventor: Kenneth Grange, GB-London, Great Britain

[73] Assignee: Warner-Lambert Company, Morris Plains, N.J.

[21] Appl. No.: 185,755

[22] Filed: Jan. 21, 1994

Related U.S. Application Data

[63] Continuation of Ser. No. 7,543, Jan. 22, 1993, abandoned.

[51] Int. Cl.[5] ..... B65D 5/52

[52] U.S. Cl. ..... 206/45.23; 206/45.2; 206/349

[58] Field of Search ..... 206/45.15, 45.18, 45.2, 206/45.23, 349, 351

[56] References Cited

U.S. PATENT DOCUMENTS

| | | | |
|---|---|---|---|
| 1,247,848 | 11/1917 | List | 206/45.23 |
| 1,378,363 | 5/1921 | List | 206/45.23 |
| 1,526,213 | 2/1925 | Humphrey | 206/45.2 |
| 1,720,274 | 7/1929 | Holden | 206/45.23 |
| 3,562,905 | 2/1971 | Rakocy et al. | 206/351 |
| 3,759,594 | 9/1973 | Cobb . | |
| 4,339,876 | 7/1982 | Davis . | |
| 4,625,402 | 12/1986 | Kavoussi . | |
| 4,666,036 | 5/1987 | Bourbon | 206/45.23 |
| 4,867,302 | 9/1989 | Takahashi | 206/45.18 |

FOREIGN PATENT DOCUMENTS

| | | | |
|---|---|---|---|
| 50639 | 11/1911 | Austria | 206/45.23 |
| 0248592 | 5/1987 | European Pat. Off. . | |
| 2571698 | 10/1984 | France . | |
| 1676546 | 5/1952 | Germany . | |
| 1754116 | 8/1957 | Germany . | |
| 2059223 | 12/1970 | Germany | 206/351 |
| 3602946 | 1/1986 | Germany . | |
| 2140781 | 12/1984 | United Kingdom . | |
| 2174075 | 10/1986 | United Kingdom . | |
| 2174978 | 11/1986 | United Kingdom . | |

*Primary Examiner*—David T. Fidei
*Attorney, Agent, or Firm*—Robert W. Becker & Associates

[57] ABSTRACT

A device for keeping a razor that, on the one hand, allows safe storage and keeping of the razor and, on the other hand, can be used as a stand from which the razor can easily be removed for its designated use includes a housing with two housing portions pivotable relative to one another, a longitudinal guide in the first housing portion and at least one guide element mounted on the second housing portion and slidable along the longitudinal guide. The guide element also forms the pivot point for pivoting the two housing portions out of a first position in which the device is closed into a second position in which the razor is accessible for removal.

13 Claims, 1 Drawing Sheet

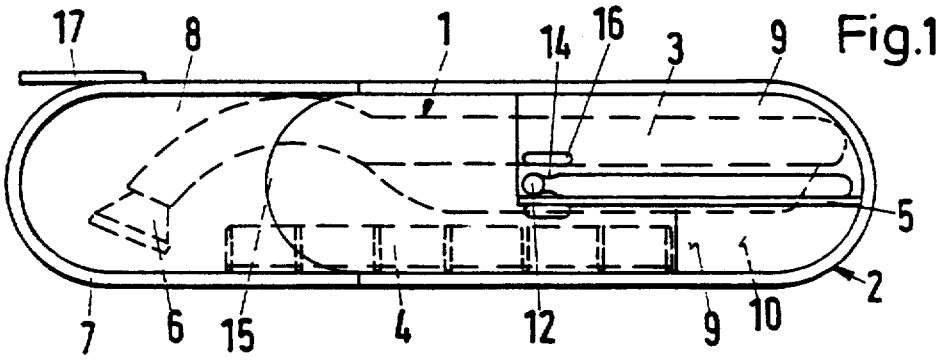
Fig.1
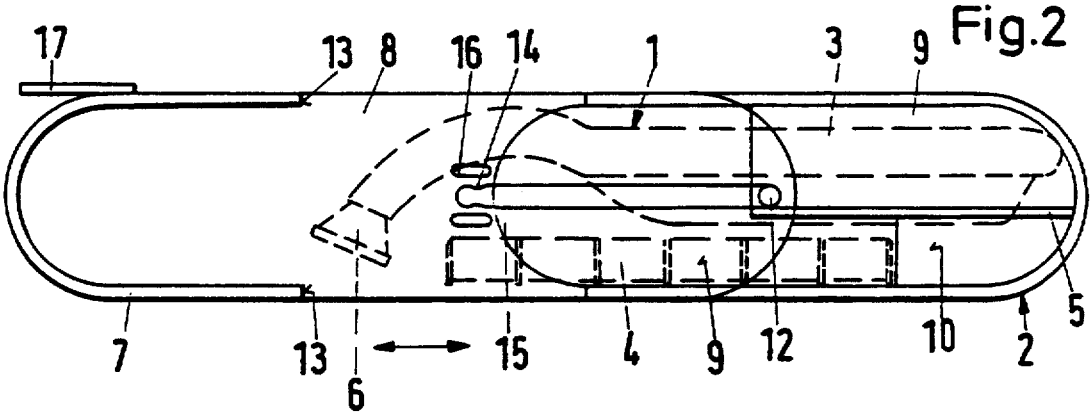
Fig.2
Fig.3
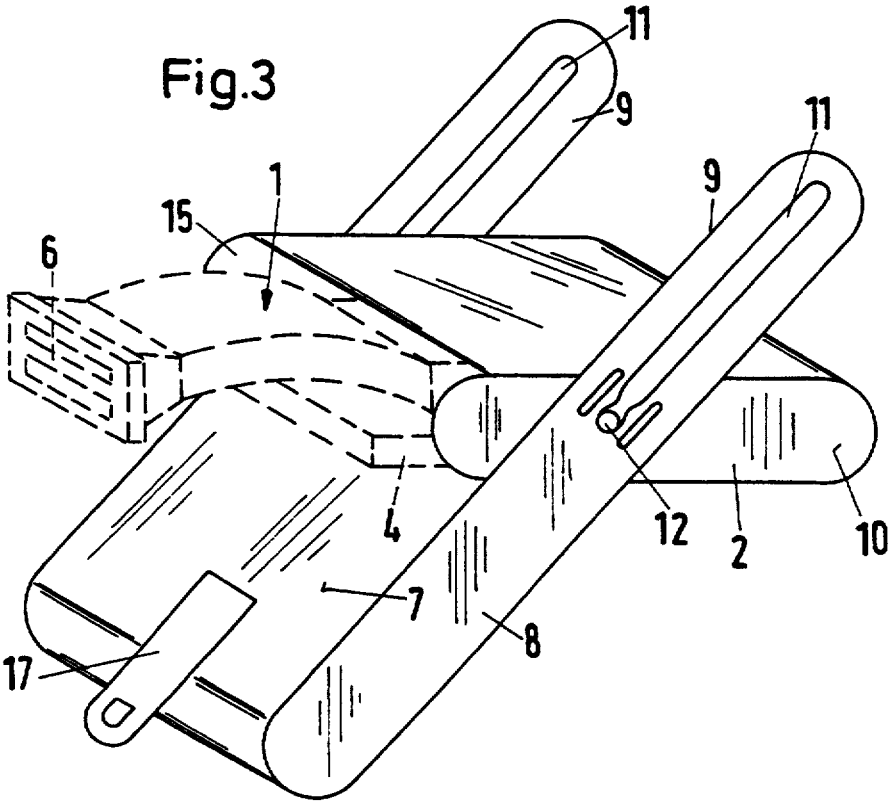

DEVICE FOR KEEPING A RAZOR

This application is a continuation of application Ser. No. 08/007,543 filed Jan. 22, 1993, now abandoned.

BACKGROUND OF THE INVENTION

The invention concerns a device for keeping a razor.

Razors and in particular wet shavers are as a rule presented in hard packages which consist of a bottom portion and a usually transparent cover portion. Such packages are suitable both for sales-promoting presentation of the razor and for protective safe keeping thereof, for example, during traveling. A disadvantage of the known packages is that they are less suitable for easy removal of the razor for daily use. Separate stands from which the razor can easily be suspended are therefore often employed by the users.

It is the object of the present invention to provide a device for keeping a razor, which, on the one hand, allows safe storage and keeping of the razor and which, on the other hand, can be used as a stand from which the razor can easily be removed for its designated use.

SUMMARY OF THE INVENTION

The solution for achieving this object is characterized by a housing comprised of two housing portions pivotably connected to one another, a first housing portion having a longitudinal guide, and at least one guide element connected to the second housing portion and slidably engaging the longitudinal guide, the guide element also forming the pivot about which the two housing portions are pivotable from a first position in which the housing is closed into a second position in which the razor is removable from the housing.

Such a device is suitable, on the one hand, for safe storage and keeping of the razor, for example, during travelling. On the other hand, the device can be stood upright by the two housing portions that are pivotable relative to one another, so that the contents, i.e., the razor and possibly extra component parts such as replacement blades, are readily accessible to the user. The device thus fulfills an additional function as a stand.

According to one further development it is provided that the two housing portions of the housing are elongate and cross each other in the second position in which the razor is removable. As a result, particularly safe standing of the device is achieved and, at the same time, easy removal of the contents.

In another embodiment of the device, the longitudinal guide is embodied by two slots, with two guide elements provided, each engaging one of said slots. Such slots are easy to make and therefore meet the requirement of easy manufacturing which is desired of packaging devices.

In order to allow rotation of the guide elements in the slot, the guide elements guided in the slot are preferably cylindrical.

For safe standing of the device, it is advantageous to provide the longitudinal guide at one end with a catch for the guide element. After pivoting of the two housing portions, they are displaced until the guide element engages the catch, so that the device is in a secure standing position.

With the invention it is further proposed that one housing portion receives the razor as well as, if desired, replacement razor blades, and can be closed by a cover formed on the other housing portion. In this case the cover encloses the head of the razor in the form of a cap.

Standing at the device in a position allowing easy access to the contents is achieved when the longitudinal guide is arranged on the housing portion forming the cover. Preferably, the catch is then arranged at the end of the longitudinal guide facing the cover.

Finally, according to on embodiment it is provided that the housing comprises a receptacle, formed by partitions, for replacement razor blades.

BRIEF DESCRIPTION OF THE DRAWINGS

Further details and advantages of the subject of the invention will become apparent from the following description of a particular embodiment shown in the drawings. The drawings show in:

FIG. 1 a side view of a device for keeping a razor in a closed position;

FIG. 2 the device according to FIG. 1 in the position pulled open in the longitudinal direction; and FIG. 3 in a simplified perspective view, the device according to FIGS. 1 and 2 in a position of use as a stand.

DESCRIPTION OF PREFERRED EMBODIMENTS

FIG. 1 shows a device for keeping a razor 1 in its closed position. The device includes a two-part housing. The housing portion 2 receives the handle 3 of the razor 1 in the form of a wet shaver, as well as a magazine 4 with replacement razor blades. The first housing portion 2 is divided by a partition 5 into two different compartments which serve to receive and support the handle 3 and the magazine 4, respectively.

The head 6 of the razor 1, including the razor blades, projects out of the housing portion 2 and, in the closed position according to FIG. 1, is enclosed by a cover 7, constructed in the form of a half-oval in the present embodiment, so that in general a package sealed on all sides is obtained. The cover 7 forms part of the other housing portion 8 which comprises two elongate lateral extensions 9 which, when the device is closed, contact the identically constructed side walls 10 of the housing portion 2. The two extensions 9 are provided with longitudinal guides in the form of slots 11. A guide element 12 in the form of a cylindrical pin attached to the housing portion 2 extends into each of the slots 11. The slots 11 in the housing portion 8 therefore form a longitudinal guide for the guide elements 12 of the housing portion 2, so that the two housing portions 2, 8 can be pulled apart along the longitudinal guide, as shown in FIG. 2.

In the relative arrangement of the parts shown in FIG. 2, the guide elements 12 abut against the ends of the two slots 11 remote from the cover 7. In this position, the cover 7 is pulled out so far that its edges 13 can be pivoted past the head 6 of the razor 1. The two housing portions 2, 8 are thus brought into a pivoted relative position in which they are crossing each other. Then, the housing portion 2 is displaced along the longitudinal guide in a direction towards the cover 7 of the housing portion 8 until the cylindrical guide elements 12 latch in a catch 14 at the end of the slot 11 facing the cover 7. This results in the position shown in FIG. 3, in which the device can be stood up. The housing portion 8 together with the cover 7 forms a support. In this position the opening 15 of the housing portion 2 faces obliquely upwards, so that razor 1 and magazine 4 can easily be removed.

The catch 14 consists of a narrowing of the slot 11 on both longitudinal sides. Narrow laterally arranged slots 16 produce the required flexibility.

In order to be able to use the device for sales-promoting presentation of the razor 1 as well, the cover 7 of the housing portion 8 designed in the fashion of a cap is provided with a suspension eye 17. Either both or one of the housing portions 2, 8 is made of transparent plastic.

The present invention is, of course, in no way restricted to the specific disclosure of the specification and drawings, but also encompasses any modifications within the scope of the appended claims.

What I claim is:

1. A storage system for keeping and retrieving a wet razor and a dispenser of spare razor blades, said storage system comprising:

a device for keeping a wet razor;

a wet razor;

a dispenser comprising at least one spare blade;

said device comprising a housing comprised of a first and a second elongate housing portions pivotably connected to one another;

said first housing portion having a longitudinal guide; and at least one guide element connected to said second housing portion and slidably engaging said longitudinal guide, said guide element forming a pivot about which said first and said second housing portions are pivotable from a first position in which said housing is closed to a second position in which said first and Said second housing portions are in a crossed arrangement;

wherein said first housing portion forms a cover and wherein said longitudinal guide projects from said cover and has at an end proximal to said cover a notch for latching said guide element; and wherein said second housing portion comprises a receptacle separated by partitions which receives said razor and said dispenser, said razor and said dispenser projecting at least partially from said second housing portion and removable from said device when said device is in said second position.

2. A device according to claim 1, wherein said longitudinal guide is comprised of two slots and wherein two said guide elements are present, each said guide element engaging one of said slots.

3. A device according to claim 2, wherein said guide elements are cylindrical.

4. A device according to claim 1, wherein said cover encloses the head of the razor in the form of a cap.

5. A storage system for keeping and retrieving a wet razor and a dispenser of spare razor blades, said storage system comprising:

a device for keeping a wet razor;

a wet razor;

a dispenser comprising at least one spare razor blade;

said device comprising a housing comprised of two housing portions pivotably connected to one another;

a first one of said two housing portions having first lateral sidewalls with a projecting portion, said projecting portion extending past said first housing portion and having a longitudinal guide with a proximal and a distal end;

a second one of said two housing portions having second lateral sidewalls corresponding to said first lateral sidewalls, each said second lateral sidewall having a guide element slidably engaging a corresponding one of said longitudinal guides;

said guide elements forming a pivot about which said two housing portions are pivotable from a first housing position into a second housing position;

in said first housing position said housing is closed and said projecting portions of said first lateral sidewalls cover said second lateral sidewalls, wherein said guide elements are positioned at said proximal end;

for opening said housing, said first and said second housing portions are moved in opposite directions relative to one another such that said guide elements slide in said longitudinal guides from said proximal end to said distal end;

with said guide elements positioned at said distal end, said first and said second housing portions are pivoted into said second housing position in which said first and said second housing portions are in a crossed arrangement, with said razor and said dispenser projecting at least partially from said housing and removable from said housing; and wherein said first and second housing portions are slidable into a third housing position by sliding said guide elements from said distal end to said proximal end in said crossed arrangement in which third housing position said device is lockable.

6. A device according to claim 5, wherein said proximal end has a catch for receiving said guide element.

7. A device according to claim 5, wherein said two housing portions are elongate.

8. A device according to claim 5, wherein said longitudinal guides are slots.

9. A device according to claim 5, wherein said guide elements are cylindrical.

10. A device according to claim 5, wherein said first housing portion forms a cover for closing said housing and said second housing portion receives the razor and replacement razor blades.

11. A device according to claim 10, wherein said cover encloses the razor in the form of a cap.

12. A device according to claim 5, wherein said housing comprises partitions for forming a receptacle for replacement razor blades.

13. A combination of a device for keeping a wet razor and a dispenser for spare razor blades with a wet razor and a dispenser for spare razor blades, said combination comprising:

a wet razor;

a dispenser for spare razor blades comprising at least one spare razor blade;

a device for keeping said wet razor and said dispenser, said device comprising:

a housing comprised of two housing portions pivotably connected to one another;

a first one of said two housing portions having first lateral sidewalls with a projecting portion, said projecting portion extending past said first housing portion and having a longitudinal guide with a proximal and a distal end;

a second one of said two housing portions having second lateral sidewalls corresponding to said first lateral sidewalls, each said second lateral sidewall having a guide element slidably engaging a corresponding one of said longitudinal guides;

said longitudinal guide having at said proximal end a notch for latching said guide element;

said guide elements forming a pivot about which said two housing portions are pivotable from a first housing position into a second housing position;

in said first housing position said housing is closed and said projecting portions of said first lateral side walls cover said second lateral sidewalls, wherein said guide elements are positioned at said proximal end;

for opening said housing, said first and said second housing portions are moved in opposite directions relative to one another such that said Guide elements slide in said longitudinal guides from said proximal end to said distal end;

with said guide elements positioned at said distal end, said first and said second housing portions are pivoted into said second housing position in which said first and said second housing portions are in a crossed arrangement, with said wet razor and said dispenser projecting at least partially from said housing and removable from said housing; and wherein said first and second housing portions are slidable into a third housing position by sliding said guide elements from said distal end to said proximal end in said crossed arrangement, wherein in said third housing position said first guide element is latched in said notch for standing up said device in said third position.

* * * * *